United States Patent [19]

Briggs

[11] Patent Number: 4,598,622

[45] Date of Patent: Jul. 8, 1986

[54] COMBUSTION INHIBITING CONSTRUCTION OF A WELT CORD

[76] Inventor: E. L. Briggs, P.O. Box 2436, High Point, N.C. 27261

[21] Appl. No.: 404,018

[22] Filed: Aug. 2, 1982

[51] Int. Cl.[4] ..... D04C 1/02; D04C 1/06; A47C 27/12; D02G 3/12

[52] U.S. Cl. ..... 87/6; 57/210; 57/212; 57/222; 57/230; 57/235; 57/904; 87/1; 87/7; 87/8; 428/377; 428/920; 428/921; 5/459; 5/483

[58] Field of Search ..... 87/1, 5, 6, 7, 8, 9; 57/212, 210, 222, 230, 235, 904, 233; 139/425 R, 420 B; 5/459, 483; 428/368, 372–389, 394, 920, 921

[56] References Cited

U.S. PATENT DOCUMENTS

| | | | |
|---|---|---|---|
| 1,108,021 | 8/1914 | Taylor | 5/345 |
| 2,107,467 | 2/1938 | Buhler | 87/6 |
| 2,111,639 | 3/1938 | Petersen | 87/6 |
| 2,165,296 | 7/1939 | Oass | 57/904 X |
| 2,290,007 | 7/1942 | Valentine | 112/419 X |
| 2,465,081 | 3/1949 | Fleischer | 87/6 |
| 2,816,415 | 12/1957 | Lappala | 57/904 X |
| 2,979,982 | 4/1961 | Weitzel | 87/6 |
| 3,028,641 | 4/1962 | Hendrie | 112/441 |
| 3,033,722 | 5/1962 | Goodloe | 87/6 X |
| 3,438,841 | 4/1969 | Zumeta et al. | 87/1 X |
| 3,482,483 | 12/1969 | Ambrose | 87/6 |
| 3,535,195 | 10/1970 | Loew | 161/101 |
| 3,578,764 | 5/1971 | Nunnally | 87/6 |
| 3,818,520 | 6/1974 | Richards | 5/345 |
| 3,857,126 | 12/1974 | Woodruff | 5/345 |
| 3,934,285 | 1/1976 | May | 428/921 X |

FOREIGN PATENT DOCUMENTS

| | | | |
|---|---|---|---|
| 112241 | 9/1979 | Japan | 57/904 |

*Primary Examiner*—John Petrakes
*Attorney, Agent, or Firm*—Henderson & Sturm

[57] ABSTRACT

This invention relates to welt cord constructions in general, and more specifically to a combustion inhibiting construction for welt cords, wherein heat conducting elements are wrapped around, and/or form the core of, the welt cord, for dissipating the heat of combustion away from the point of contact with a source of heat such as a burning cigarette.

4 Claims, 7 Drawing Figures

FIG. 1.
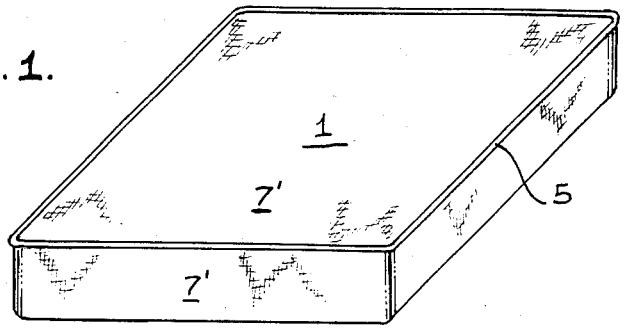
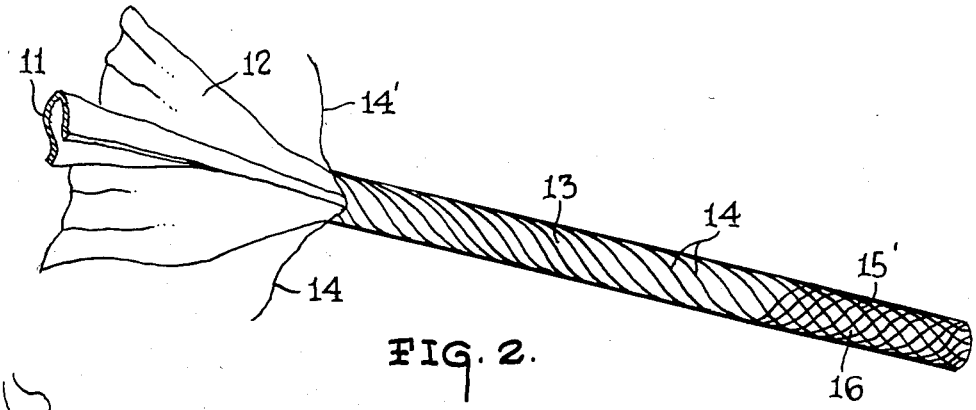
FIG. 2.
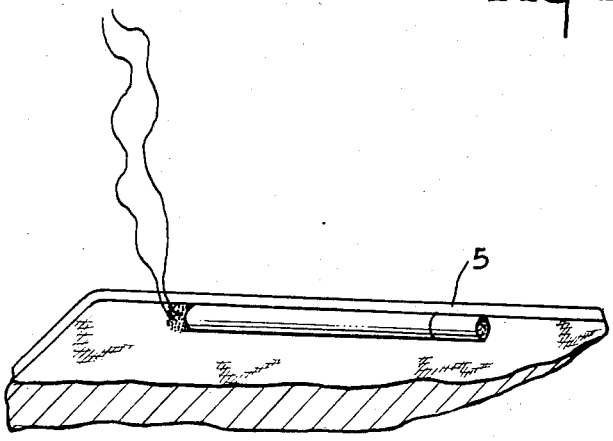
FIG. 3.
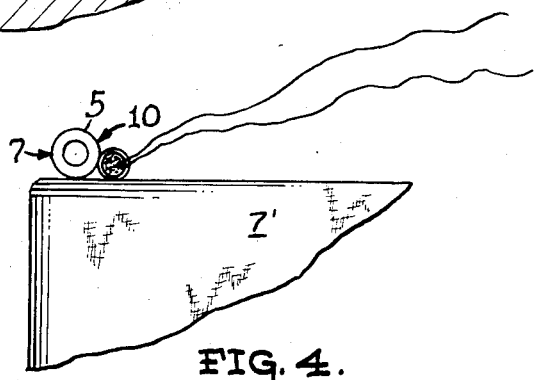
FIG. 4.

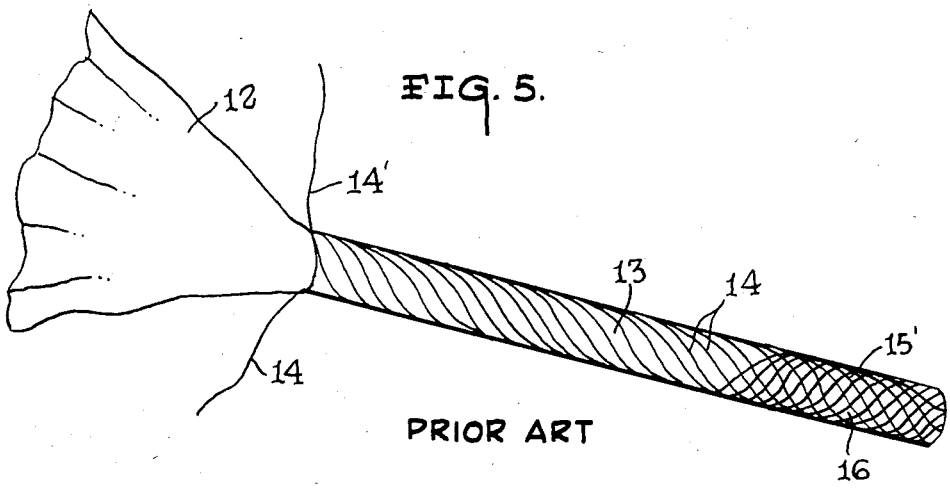
FIG. 5.
PRIOR ART
FIG. 6.
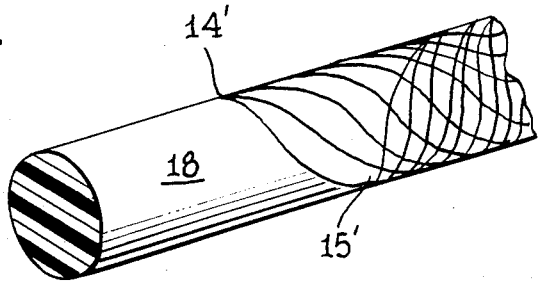
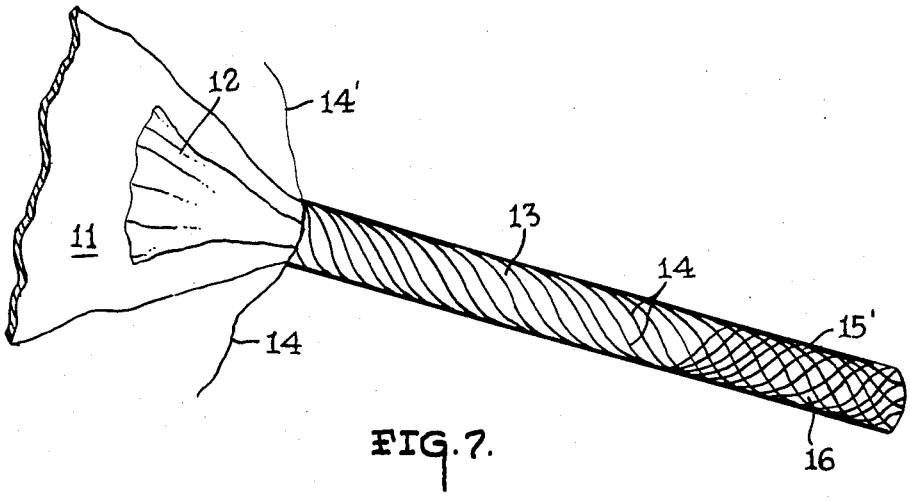
FIG. 7.

COMBUSTION INHIBITING CONSTRUCTION OF A WELT CORD

BACKGROUND OF THE INVENTION

In 1972, the Department of Commerce started the investigation and development of a standard under the Flammable Fabrics Act for upholstered furniture, the effect of which would be to reduce the hazard of ignition caused by smoldering dropped cigarettes. Subsequently, responsibility for enforcement of the Flammable Fabrics Act was transferred to the Consumer Product Safety Commission. The Commission identified ignition of upholstered furniture by carelessly dropped cigarettes as being the principal cause of death from residential fires. Since that time, the industry has adopted a voluntary program designed to reduce the hazard of cigarette ignition of upholstered furniture. In an effort to achieve this objective, the welt cord was developed.

Fire safety research had shown that, in the typical scenario, a burning cigarette is often placed at or rolls to a position where it is abutting the welt cord which is often incorporated as a design feature around the cushion perimeter in many items of upholstered seating. The cord location and construction make it particularly susceptible to cigarette ignition as the welt is covered with additional fabric which is sewn in such a manner so as to produce a double, triple or quadruple thickness of fabric, thus adding combustible fuel (the fabric and the welt cord itself) into the edges of the cushion. This additional fuel makes the edges of the cushion more susceptible to ignition by a smoldering cigarette or other ignition sources. While other efforts are needed to improve the cigarette resistance of furniture, improvement of the welt cord construction was and is critical.

This invention represents a substantial alteration of welt cord construction which will contribute significantly to a reduction in upholstered furniture fires by the use of a heat conducting welt cord which will dissipate the heat caused by a lighted cigarette and thereby prevent the ignition of the piece of furniture which would normally occur at the welt cord location. The use of a heat conducting welt cord is effective in eliminating the potential for cigarette ignition at the welt cord location where exposure to a lighted cigarette would normally result in self-sustaining ignition. Inclusion of a heat conducting metal such as aluminum foil or other strip-like heat conductive materials in the welt cord construction assists in dissipating heat away from the burning cigarette. This invention also envisions construction whereby a metallic thread is wrapped around the welt cord to substantially reduce the ignition propensity of the construction of the cord and drastically improve the fire retardant features of the upholstery into which it was incorporated.

SUMMARY OF THE INVENTION

A primary object of the present invention is to provide a heat dissipating welt cord construction to improve the flame retardant properties of upholstered articles.

A further object of the present invention is to elevate the standards of upholstered articles to meet the voluntary objectives of the Consumer Product Safety Commission.

Another object of the present invention is to incorporate heat dissipating elements into the usual welt cord construction, to lower the temperature in the welt cord, created by an external source of combustion, to a value below the ignition point.

Still another object of the present invention is to produce a welt cord having disparate heat dissipating elements formed on its external and/or internal surfaces.

Yet another object of the present invention is to incorporate a flexible strip or sheet of heat dissipating material into the core of the welt cord, to transmit heat axially along the welt cord, and away from an external source of combustion while still maintaining the flexibility of the welt cord for use in furniture.

A still further object of the present invention is to incorporate strands of heat dissipating material in the external periphery of the welt cord, to transmit heat in a spiral path away from an external source of combustion.

These and other objects, advantages, and novel features of the invention will become apparent from the detailed description which follows when considered in conjunction with the accompanying drawings.

BRIEF DESCRIPTION OF THE DRAWINGS

FIG. 1 is a perspective view of the welt cord of this invention as it would appear installed on an upholstered article.

FIG. 2 is a detailed view of the various components which compise the improved paper welt cord construction.

FIG. 3 is a perspective view of the normal position that a carelessly handled cigarette will assume with respect to the welt cord.

FIG. 4 is a sectional view of the normally occurring relative positions of a burning cigarette and the welt cord.

FIG. 5 is a perspective view of the prior art construction of the paper welt.

FIG. 6 is a perspective view of an improved construction for plastic welt cords.

FIG. 7 is a perspective view of a modified construction of the welt cord illustrated in FIG. 2.

DETAILED DESCRIPTION OF THE PREFERRED EMBODIMENT

FIGS. 1, 3 and 4 show a typical embodiment, wherein a welt cord constructed in accordance with this invention would be found. This illustration depicts a cushion, 1, whose upper perimeter is defined by a welt, 5, which contains the welt cord, designated generally as 10.

As anyone familiar with the upholstery industry is aware, in order to form the welt, 5, the welt cord, 10, which is normally covered by a single thickness of fabric 7 may be combined with the bordering fabric panels, 7' in such a manner so as to produce a double, triple or quadruple thickness of fabric. This fabric thickness combines to form a substantial volume of combustible fuel which is susceptible to ignition by a smoldering cigarette or the like. As mentioned earlier, the position of the welt, 5, on the periphery of the cushion makes it the most likely place for an unattended burning cigarette to come to rest against, due to the tendency of this cylindrical object to roll on the cushion surface until it encounters an abutment.

It is for this reason that the welt cord constructions illustrated in FIGS. 2, 6 and 7 were developed. Prior to describing the improved welt cord 10 a brief description of the most common forms of welt cord construction is deemed necessary for a thorough understanding of this invention.

Welt cords normally fall into two distinct categories: the extruded plastic welt cord; and the wrapped or twisted paper welt cord. Since the ignition temperature of the plastic is significantly higher than that for paper, it is the latter welt cord which the inventor deems most significant although improvements in both welt cords are covered by this invention.

The prior art paper welt cord as shown in FIG. 5 is normally constructed in the following manner. A wide, elongated, thin, flat sheet of paper 12 or paper like product is threaded through a die to form the cord body 13. The cord body is then loosely braided or wrapped with cloth thread 13, in a knitting or braiding machine, to produce the finished paper welt.

The improved paper welt cord of this invention can be made in one of three different ways using exactly the same machinery in exactly the same manner as described above.

The improved welt cord 10, shown in FIG. 2, is constructed in exactly the same manner as above; however, an elongated flat strip, 11, of heat conductive material, having a width less than the sheet of paper, 12, is centrally disposed on the sheet of paper and simultaneously fed through the die to form the welt cord body, 13. The welt cord body is then placed into the braiding or knitting machine which loosely wraps or braids the cord body with cloth thread, 14.

An alternative or second method of constructing the welt cord also shown in FIG. 2, is to construct the welt cord as above with the flat sheet of heat conductive material, 11, centrally disposed; however, when the welt cord body, 13, is placed in the braiding machine, thin flexible metallic thread, 14', such as the type normally used solely for decorative purposes and which has heat conducting properties, is substituted for the cloth thread 14 to produce the improved welt cord. The final product of this second method then comprises a cord body, 13, having a crushed contiguous strip of heat conducting material 11 which forms its core surrounded by the paper 12, and a metallic braided exterior surface, 15'.

The third manner of constructing the improved welt cord, 10, is to thread a wide, elongated thin flat sheet of paper or paper like product, 12, through the die in the normal manner and without the heat conducting material forming the cord body, 13. The welt cord body, constructed in accordance with the prior art method, is then placed into the braiding machine and as in the second method described above, thin flexible metallic thread, 14', is substituted for the cloth thread 14 to produce the improved welt cord, 10.

In addition since the wrapping or braiding machines are dimensioned to receive plastic welt cords, 18, having diameters equal to or less than the paper cords, this invention further contemplates wrapping the exterior surface of plastic welt cord body 18, with the metallic heat conducting threads 14' mentioned, supra.

The heat conducting strip of material, 11, which was chosen for the preferred embodiment comprised a continuous strip of metal foil (preferably aluminum) having a minimum width of 9.53 mm and a minimum thickness of 0.0254 mm. Extremely thin metal foil is ideal for this construction for the following reasons: its dimensions, particularly its thickness, allow it to be used in conjunction with the paper sheet with no modifications to the machinery currently employed in manufacturing the paper welt cords; the surface area to weight ratio of the foil makes it an excellent conductor of heat; and the small mass and flexibility of the crumbled foil core does not impart noticeable weight or rigidity to the finished product which is of particular importance given the need for flexibility in the welt cord in order to be of practical use in upholstered furniture.

Other heat dissipating elements that are contemplated as suitable substitutes for the metal foil are as follows: a thin strip of plastic film having a thin, uniform metallic coating deposited thereon; and a thin, elongated strip of plastic film having a non-uniform contiguous coating of particles or flakes of heat conducting material, such as carbon or the like, adhering to the surface of the plastic film.

The reversal of the relationship between the paper and the foil to produce a welt cord is also contemplated by this invention; (see FIG. 7) and the end product of this reversal of elements would be a paper 12 welt cord surrounded by a metallic foil 11 sheath or body 13. The substitution of the heat conducting strip 11 or skeins 14' of metallic thread for the paper in the welt cord core is also contemplated by this invention. As in the preferred embodiment, no modification of the existing machinery used to fabricate the prior art paper welt cord is required.

With respect to improved welt cord 10, and as can be seen in FIG. 2, the intersecting spiral thread wrappings form small interstices, 16, which represent the reduced surface area of the cord body, 13, which is exposed to the direct heat of combustion. The surface area under the metallic threads 14' is protected by the heat conducting properties of the threads. These metallic threads 14' will dissipate the heat away from the source of external combustion, in a well recognized manner, and should prevent the temperature in the core body from reaching the ignition temperature in the area proximate to the burning cigarette or the like, in a significant number of instances.

Since the paper welt cords have a lower ignition temperature, the metal foil core of the first embodiment described will tend to dissipate the heat of combustion away from the area where the paper body may have ignited or reached the smoldering point. This foil core will further substantially reduce the likelihood that the fire will spread along the cord body, 13.

Having thereby described the subject matter of this invention it should be obvious that many substitutions, modifications, and variations of the invention are possible in light of the above teachings. It is therefore to be understood that the invention as taught and described is only to be limited by the breadth and scope of the appended claims.

What I claim is:

1. In upholstered furniture having a welt comprising a welt cord covered by at least a single thickness of a fabric, an improved welt cord construction for inhibiting the spread of combustion in said fabric when exposed to a source of combustion; wherein, the improved welt cord construction consists of:

a welt cord body comprising an elongated thin strip of metal foil which forms at least a portion of the core of said welt cord body;

an elongated thin sheet of paper encompassing the core of said welt cord body; and at least one metallic thread spirally wound around the said sheet of paper and the core of said welt cord body.

2. An improved welt cord construction as in claim 1, wherein, said elongated sheet of paper is twisted around the core of said welt cord body.

3. An improved welt cord construction as in claim 1; further comprising:

a plurality of metallic threads wound around said thin sheet of paper and thin strip of metal foil to form a metallic braided exterior surface on said welt cord body.

4. An improved welt cord construction as in claim 1; further comprising:

a plurality of metallic threads spirally wound around said thin sheet of paper and thin strip of metal foil, wherein the spiral thread wrappings form small interstices on the exterior surface of said welt cord body.

* * * * *